United States Patent [19]

Evans

[11] 3,977,929

[45] Aug. 31, 1976

[54] CORRUGATOR

[75] Inventor: Donald J. Evans, Cherry Hill, N.J.

[73] Assignee: Molins Machine Company, Inc., Camden, N.J.

[22] Filed: June 13, 1973

[21] Appl. No.: 369,632

[52] U.S. Cl. ..... 156/64; 156/205; 156/351; 156/361; 156/378; 156/470

[51] Int. Cl.[2] ..... G05G 15/00

[58] Field of Search ..... 156/60, 64, 205, 206, 156/210, 271, 351, 358, 359, 367, 378, 462, 470, 361

[56] References Cited

UNITED STATES PATENTS

| | | | |
|---|---|---|---|
| 2,482,627 | 9/1969 | Langston | 156/367 |
| 2,941,573 | 6/1960 | Cassady | 156/60 |
| 2,985,223 | 5/1961 | Thorn | 156/470 |
| 3,004,880 | 10/1961 | Lord | 156/210 |
| 3,104,997 | 9/1963 | Stewart et al. | 156/210 |
| 3,306,805 | 2/1967 | Klein et al. | 156/470 |
| 3,408,886 | 11/1968 | David | 83/359 |
| 3,411,388 | 11/1968 | Rappaport | 156/64 |
| 3,472,158 | 10/1969 | Shields | 156/60 |
| 3,510,374 | 5/1970 | Walker | 156/360 |
| 3,730,810 | 5/1973 | Klein | 156/462 |
| 3,785,902 | 1/1974 | Preston et al. | 156/367 |

*Primary Examiner*—William A. Powell
*Assistant Examiner*—David A. Simmons
*Attorney, Agent, or Firm*—Seidel, Gonda & Goldhammer

[57] ABSTRACT

The separate machines of a corrugator are coupled so that they can be operated in synchronization. The separate machines are controlled as a unit by use of tachometer feedback signals which eliminate motor speed drift and permit operation at relatively high speed during an order change.

12 Claims, 7 Drawing Figures

CORRUGATOR

When an order change was made on a corrugator heretofore, the downstream end was operated at a faster speed than the upstream end to create a gap in a transversely cut web. By means of a clutch or some other device, the speed of the upstream end was slowed down. The slitter-scorer was rotated during a gap in the web to position a new set of knives for slitting the new web. If necessary, the cutoff machine was adjusted for a new sheet length. Then the upstream end of the corrugator was brought up to the desired corrugator speed.

In this invention, the component machines of the corrugator are coupled so as to be in synchronous operation and controllable as a unit. The object is to produce more uniform paperboard at synchronous speeds with minimum time lapse between order changes consistent with moisture and temperature equilibrium of the paperboard. At order change time, the speed of the corrugator is kept quite high so as to avoid disturbing equilibrium conditions of moisture and temperature of the paperboard.

At the upstream end of the corrugator, there is provided a preheater for the web. Idler rollers are mounted on a common frame. An operator may jog a control switch to cause the idler rollers to simultaneously elevate or descend to any desired position. At the control panel, the operator may turn a dial to that speed which is indicative of the lowermost position for the idler rollers. The idler roller support arms follow the line speed setting and move so that the amount of wrap is proportional to speed. That is, the operator has the choice of determining the speed at which the idler rollers will be in their lowermost position wherein maximum heat is transferred to the web and vice versa. The idler rollers will move in proportion to changes in line speed to maintain a uniform transfer of heat to the web.

A voltage-sensitive relay is coupled across first and second rheostat motors (motor operated potentiometer). One such motor is part of the speed setting means of the main drive motor for the single facer machine. The other rheostat motor is utilized to move the idler rollers up and down at the single facer preheater and moves the rheostat that is geared to it. If the speed of the single facer machine decreases, this will be detected by the voltage-sensitive relay and cause the idler rollers on the preheater to move upwardly so as to decrease the amount of heat transferred to the web and vice versa. Thus, the idler rollers in the preheater are positioned at an elevation which is responsive to the speed of its single facer machine which in turn corresponds to the speed of the entire corrugator.

At a preconditioner for the single facer machine, valves for the steam shower are motor-controlled and the speed for maximum steam discharge can be adjusted by means of a dial at the control panel, in the same manner as the amount of wrap is adjusted. This permits shower discharge rates to be correlated and modulated with respect to web speed. The valves are operated by motors in substantially the same manner as described above in connection with the preheater wherein one vernier knob will give maximum discharge from the showers at a speed such as 500 feet per minute by means of the dial at the control panel. As speed increases, the amount of discharge increases and vice versa. The adjustment for opening of the valves is not necessarily correlated for speed. That is, the web can be moving at 400 feet per minute but the shower dial position serves to discharge a larger or lesser amount of steam following a variety of different curves whereby the operator has selection in how much steam he wants regardless of the speed of the web. This permits an operator to provide more steam with heavier grade webs as compared with lighter grade webs both travelling at the same speed.

At the preconditioner, the shower valves extend across the full width of the machine. The machine is generally designed to handle webs within a range such as 77 to 97 inches. If the operator runs a 77 inch width web, he may position a knob or dial at the control panel to indicate this. Manipulation of that knob automatically shuts off the redundant valves on opposite sides of the machine. In this manner, only the necessary number of steam valves are utilized as a function of the width of the web being processed at any given time.

At the control panel, there is a digital potentiometer wherein the operator may dial in the width of the web and thereby automatically cause the dam at the single facer machine to be moved to a position corresponding to the width of the web. This may be accomplished in a manner whereby the dams are moved toward and away from each other to thereby control the width of the glue application zone. The dams may be connected to a lead screw shaft driven by a potentiometer controlled motor which functions as set forth above in connection with the motor for the preheater.

The bridge between the single facer machine and the double facer machine may be a double deck bridge so that double wall board paperboard may be made. In double wall board, one single faced web is joined to another single faced web which in turn is joined to a liner. At the control panel, a digital potentiometer permits the operator to dial the width of the web being processed which will automatically adjust the width of the web guides on the bridge. At the control panel, a three digit knob may be provided which will enable the operator to position the width of the bridge guides slightly more than the width of the web. This same three digit knob can be used to open the bridge guides an additional 3 inches by simply turning it to a setting of 999 and pressing a set button. This is advantageous during threading. After threading, the knob is turned back to a setting of 000 (or the appropriate trim) and, the set button pressed again.

At the bridge, means may be provided to automatically count the amount of single faced web fed into the bridge and the amount of single faced web fed out of the bridge whereby the difference will represent the amount of single faced board on the bridge. Some users of corrugators prefer to maintain a uniforn amount of single faced board on the bridge regardless of speed. Such counters are commercially available and may be utilized at the bridge if desired.

The single facer machine is preferably provided with a web break detector. If the web breaks at the single facer machine, it wraps around the corrugating rolls and may damage the machine as well as causing a substantial amount of down time. On the exit side of the single facer machine, the single faced web is preferably detected by a web break detector which is responsive to a function of thickness of the single faced web. When there is a lack of a sufficient distance between two detector components, a signal is generated which can stop the entire corrugator.

In the corrugator of the present invention, there is no clutch between the upstream and downstream ends so that they remain in synchronous operation. When an order change is required, a gap in the web is created by a shear blade on the upstream side of the cutoff machine and slitter-scorer. The shear blade cuts the web to define a gap. When the gap reaches the slitter-scorer, the latter is adjusted so as to provide slitter blades in a position for cutting the next web. If necessary, the cutoff machine is adjusted to any new length of the sheets to be cut. The shearing of the web into sheets is for a time period which is adjustable from about three seconds to about twenty seconds. During this time, all components of the corrugator are operating at the synchronous speed although it will be a reduced rate. Thereafter, the web continues to be processed in a normal manner.

If desired, the corrugator may be controlled manually. When going from synchronous to manual control, the single facer machine will remain at the same speed as the double facer machine. There may be provided a slow-hold button which, when pushed, will cause all of the motor-driven rheostats (motor operated potentiometer) to be left in the same position while at the same time each component machine will be driven from its separate control. In this manner, it is possible to resume automatic synchronous operation at the speed which was set before the changeover. Other safety features in connection with speed controls are set forth hereinafter.

It is an object of the present invention to provide a novel corrugator.

It is another object of the present invention to provide a corrugator electrically interrelated so that all components may operate in synchronous speeds desired.

It is another object of the present invention to provide a corrugator which permits modulation of preheating, modulation of shower steam control, and selective adjustment of the bridge, dams, etc. while including means for detecting breakage of the web at the single facer machine.

It is another object of the present invention to provide a corrugator wherein all major components are coupled together by a tachometer feedback drive for synchronous operation while permitting manual operation of various component machines.

It is another object of the present invention to provide a corrugator having only moderate reduction in speed during order changes.

It is another object of the present invention to provide a corrugator electrically interrelated in a manner so as to avoid disturbing equilibrium conditions of temperature and moisture of the web for purposes of minimizing warpage of the web.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
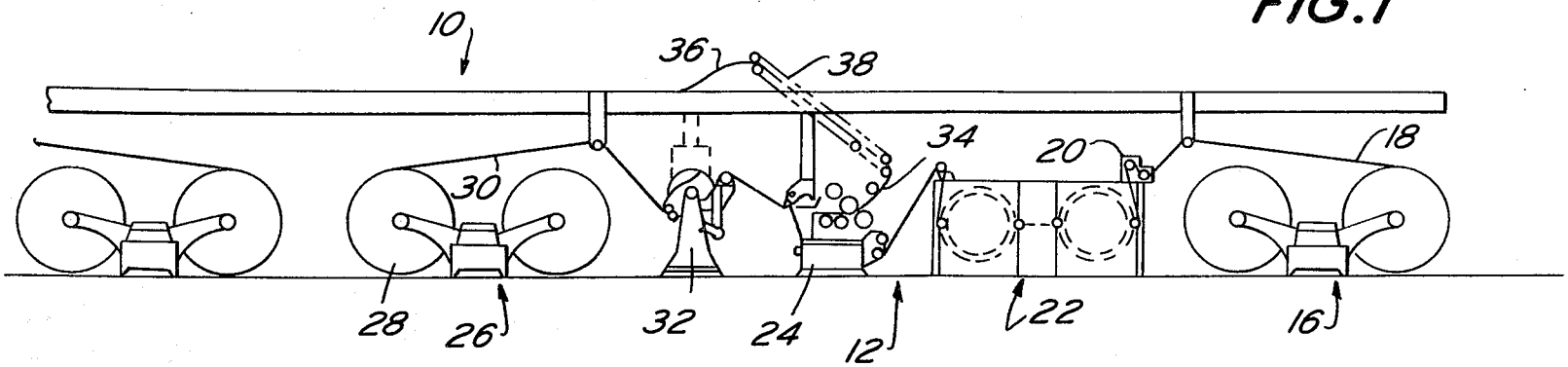
FIGS. 1–4 are schematic side elevation view of a corrugator.
Figure 4:
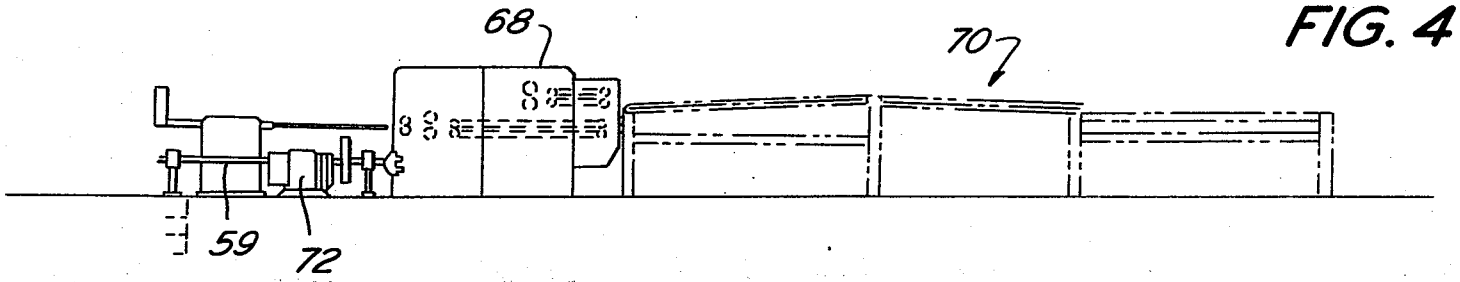
Figure 2:
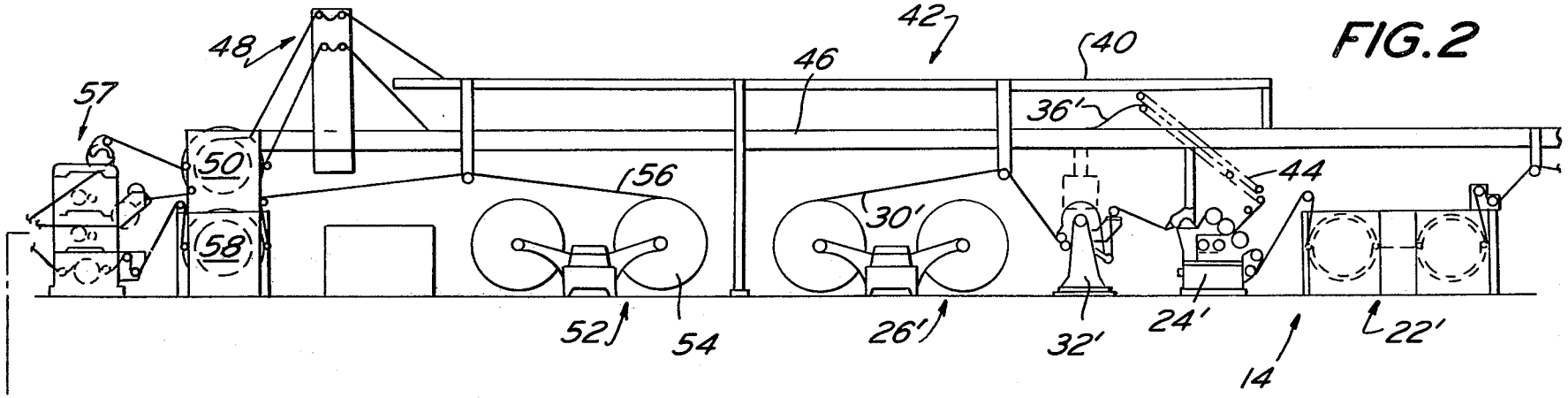
Figure 3:
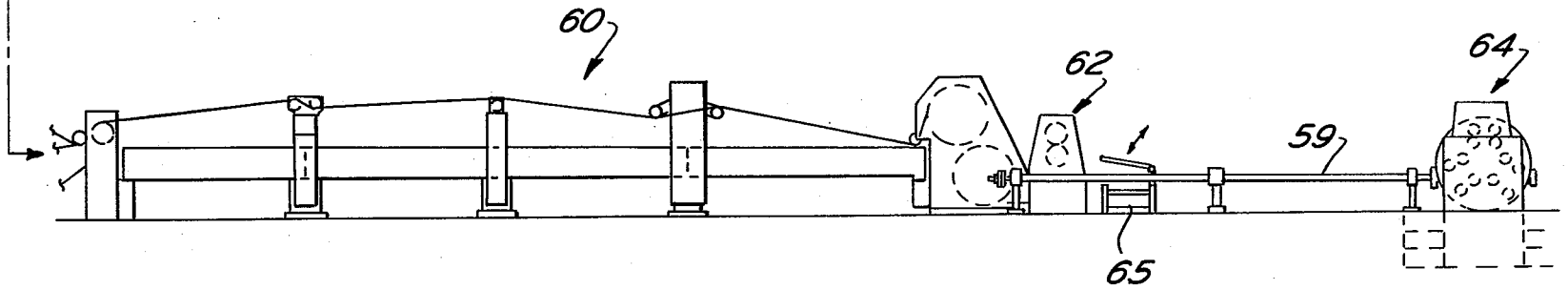

Referring to the drawing in detail, wherein like numerals indicate like elements, there is shown in FIGS. 1–4 a corrugator designated generally as 10. The corrugator 10 at its upstream end includes first and second single facer systems 12 and 14 which are illustrated in FIGS. 1 and 2. The systems 12 and 14 may be operated individually or simultaneously depending upon the type of paperboard being processed. Since systems 12 and 14 are identical, only system 12 will be described in detail with corresponding primed numerals being applied to corresponding structure of system 14.

The single facer system 12 includes a first mill roll stand 16 for supporting rolls of a web liner 18. The liner 18 is fed through a tension control device 20 and then threaded through a dual drum preheater 22. The preheated liner 18 is then fed to the single facer machine 24.

A second mill roll stand 26 is provided for supporting rolls 28 of a corrugating medium 30. The corrugating medium 30 is fed through a preconditioner 32 having a steam shower system. The preconditioned corrugating medium 30 is fed to the single facer machine 24 where it is corrugated and then adhesively bonded to the liner 18. At the discharge side of the single facer machine 24, there is provided a web break detector 34 for detecting the presence or absence of the single faced web 36.

The single faced web 36 is fed by conveyor 38 to the upper level 40 of an adjacent bridge 42. The single faced web 36' is fed by the conveyor 44 to the lower level 46 of the bridge 42. It will be noted that the single facer system 14 is disposed beneath the bridge 42.

The single faced web 36, when present, exits from the bridge 42 around the bridge guide 48 having idler rollers and then is preheated. Preheating of the single faced web 36 may be accomplished by causing it to partially extend around heated drum 50. The single faced web 36', when present, exits from the bridge 42 around the bridge guide 48 and then is preheated. Preheating of the single faced web 36' may be accomplished by causing it to partially extend around said drum 50.

A mill roll stand 52, beneath the bridge 42, supports one or more rolls 54 of a liner 56. When one of the rolls 54 is exhausted, the liner 56 is joined to the web liner on the other roll. The liner 56 is preheated such as by partially extending it around a heated drum 58. A double deck glue machine 57 applies an adhesive bonding agent to the crests of the flutes on the single faced webs 36,36'. If both single faced webs 36,36' are simultaneously present, they are bonded to each other with the lower web being also bonded to the liner 56 in the double facer machine 60. The double facer machine 60 maintains the single faced webs in contact with each other with one web in contact with the liner 56 while subjecting these components to controlled heat to gelatinize a starch solution, when used as the adhesive bonding agent, whereby the starch solution becomes an adhesive.

The double facer machine 60 preferably includes a source or heat below the web of paperboard. The source of heat is preferably a plurality of heat chests or plates which may be selectively moved to a minimal heat transfer position as a function of decreased speed. In this regard, the selectivity is provided to facilitate the proper heat transfer as a function of speed with the object of attaining uniform paperboard without warp.

The web of paperboard exits from the drive end of the double facer machine 60 at which location there is provided a rotary shear 62. The rotary shear 62 includes cooperating blade structure for cutting the web of paperboard transversely into sheets and causing the sheets to be discharged downwardly onto conveyor 65. The conveyor 65 transports the cut sheets in a transverse direction for subsequent use. The cutting of the web transversely creates a gap in the web. When the trailing end of the web reaches machines to be described hereinafter, a changeover can be attained as will be set forth hereinafter.

The shear 62 is inoperative except when it receives a signal to cut the web transversely into sheets for a short period of time such as 3 to 20 seconds. Downstream from the shear 62, there is provided a slitter-scorer 64 which slits and/or scores the web of paperboard into strips while trimming the edges of the web. The slitter-scorer 64 may be of a conventional triplex type. The slit web is then directed by a web table through a cut-off machine 68 wherein the slit web is cut into sheet lengths and transported to one of various transversely disposed conveyors of a sheet delivery and stacker system 70.

Figure 7:
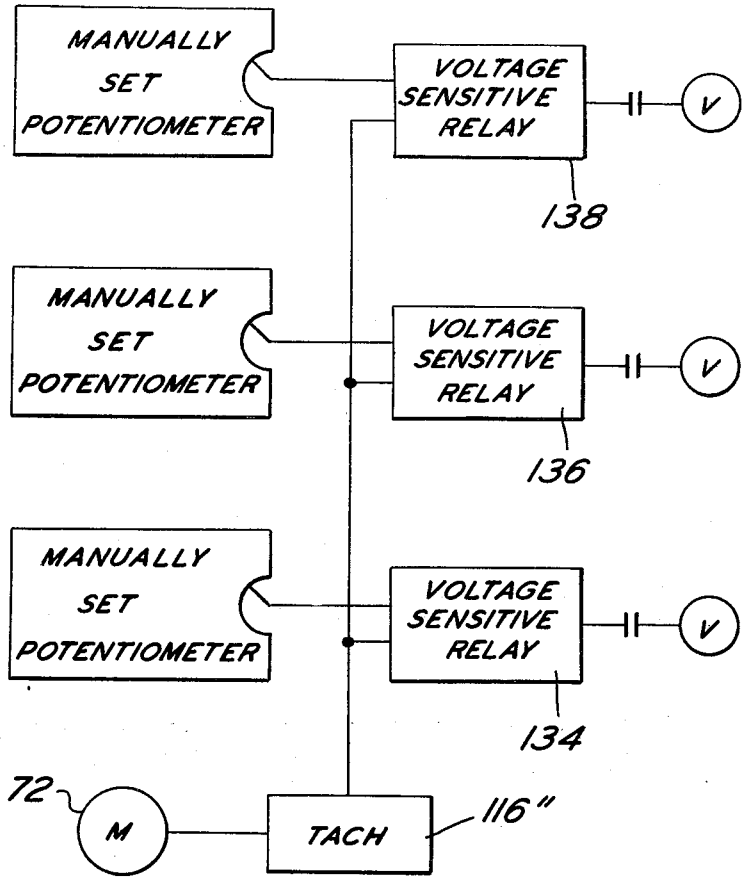
FIGS. 6 and 7 are schematic circuit diagrams.

The main drive motor 72, in addition to being mechanically coupled to the double facer machine 60, is coupled to the cut-off machine 68, the slitter-scorer 64, the rotary shear 62 and is electrically coupled to the single facer machines 24,24'. A representative block diagram of the speed control system is shown in FIGS. 5–7.

Figure 5:
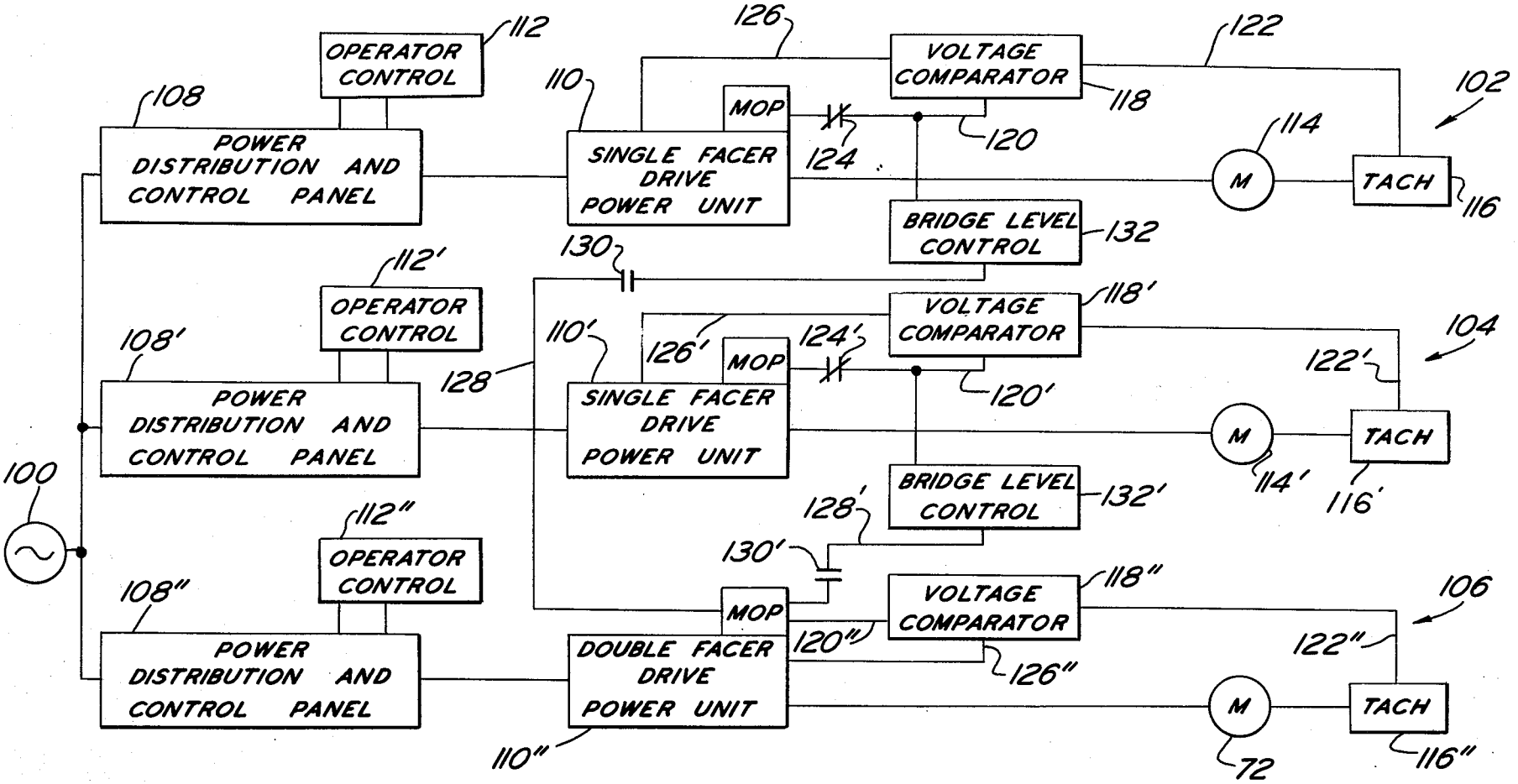
FIG. 5 is a block diagram of control circuits.
Figure 6:
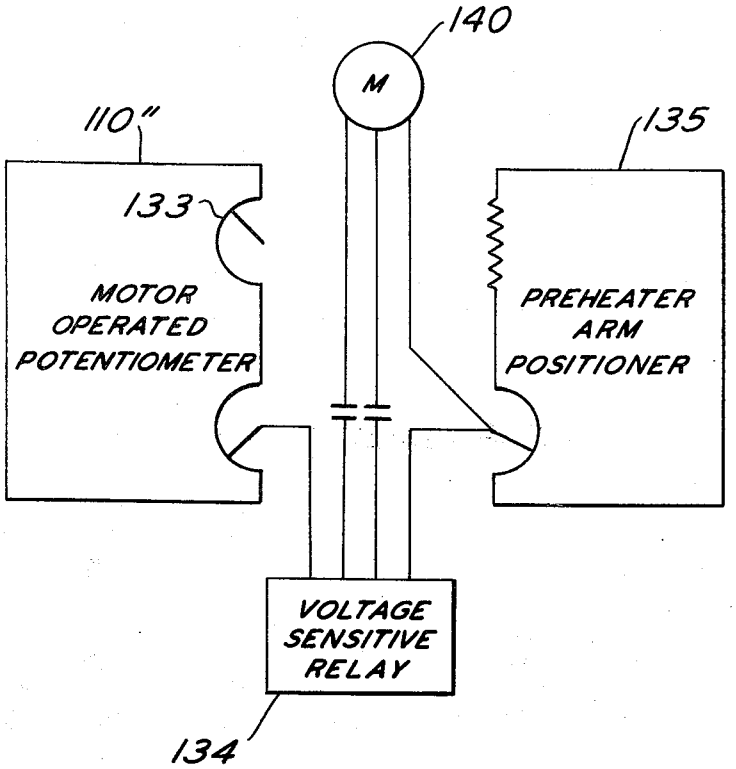

In FIG. 5 there is illustrated a block diagram of the speed control system incorporated in the corrugator 10. A source 100 of electrical power in the plant power is coupled to the circuits 102, 104 and 106. The circuit 102 is a simplified diagram showing the drive portion of the electrical system for the single facer system 12. Circuit 104 is a similar simplified diagram for the second single facer system 14. Circuit 106 is the simplified diagram for the double facer machine 60. The circuits 102 and 104 are identical to circuit 106 except as will be made clear hereinafter.

The circuit 102 includes a power distribution and control panel 108 coupled to the single facer drive 110. An operator control 112 is coupled to the single facer drive 110 by way of the power distribution and control panel 108 to effect starting and stopping of the single facer drive 110 as well as to control the rate of speed of the single facer drive 110 by way of a MOP (motor operated potentiometer) forming a part of the single facer drive 110. The single facer drive 110 includes a power unit coupled to the single facer motor 114 of single facer system 12. Motor 114 has a tachometer generator 116 coupled thereto.

The MOP in the single facer drive 110 is connected to a voltage comparator 118 by way of the conductor 120 and transmits a reference signal thereto. The conductor 120 is provided with a normally closed switch 124 therein. The purpose of switch 124 will be made clear hereinafter. The voltage comparator 118 is connected to the single facer drive 110 by way of the conductor 126 for transmitting a control signal. The tachometer generator 116 is connected to comparator 118 by conductor 122 and transmits a feedback signal indicative of actual motor speed.

A conductor 128 having a normally open switch 130 is coupled between the conductor 120 and the MOP in the double facer drive 110''. By opening switch 124 and closing switch 130 the single facer drive 110 and the single facer motor 114 will be responsive to and driven in synchronization with the double facer drive 110'' and the main drive motor 72. Switches 124' and 130' in circuit 104 are manipulated in a similar manner. Thus, instead of the corrugator 10 being run as independent machines, it will operate as one single machine with the components in synchronization.

A bridge level control 132 is provided between switch 130 and voltage comparator 118. An identical bridge level control 132' is provided between switch 130' and voltage comparator 118'. Each bridge level control contains an up-down counter to which data is transmitted indicative of the footage of single faced paperboard fed to and removed from the respective levels of the bridge 42. The desired amount of single faced paperboard on the bridge is entered into the controls 132,132' by a thumbwheel. The bridge level controls 132,132' compare the amount desired to the actual footage on the bridge and produce an error voltage. The error voltage is substracted from or added to the reference signal of conductors 128,128'. The speed of the single facer motors 114,114' is thereby raised or lowered so that the footage of single faced paperboard on the bridge 42 is corrected to that desired.

FIG. 6 is a schematic diagram of the MOP for the double facer preheater arm positioner 135 with respect to drums 50,58 and its relationship to the MOP in the double facer drive 110''. The potentiometers are coupled by conductors to a polarized voltage sensitive relay 134. The relay 134 is coupled through normally open contacts to a motor 140 which drives the potentiometer on the preheater arm positioner 135 to balance the MOP. Thus, the preheater arm positioner 135 will raise or lower the idler rollers for the liner 56 with respect to the heated drum 58 to vary the amount of wrap directly with line speed. Therefore, the amount of heat transferred to the liner 56 by contact with the heated drum 58 is maintained constant.

The arms on the preheaters 22 and 22' follow the MOP of the single facer drives 110 and 110' respectively in exactly the same manner.

Shower nozzles are also provided on the beam at the top of each single facer machine 24 and 24' across the full width thereof. Each shower nozzle is individually operated by a valve. If the width of the medium is less than the length of the showers, the nozzles at the ends will be rendered inoperative by manipulating a dial at the control panel. As the speed of the medium increases, the discharge from the shower nozzles will be automatically increased by means of circuitry comparable to that shown in FIG. 6. As the speed of the medium 30,30' decreases, likewise the discharge from the shower nozzles will be similarly decreased. The showers on the preconditioners also vary in discharge volume in the same way as the showers on the single facer machines.

The rotary cut-off machine 68 and the shear 62 are driven by the double facer line shaft 59 and therefore are always in synchronization with the double facer machine 60.

As shown in FIG. 6 a manually adjustable potentiometer 133 is provided to permit the operator to compensate for different types of liner material whereby he may selectively adjust the amount of wrap as a function of the material being processed. For instance, one type of material may have to go from zero to full wrap during a change from zero to full speed while another type of material may require from zero to full wrap when going from 0 to 50 percent speed. In FIG. 6, the fixed resistor in positioner 135 permits locating the range potentiometer in the double facer drive 110'' rather than in the feedback potentiometer of the preheater arm positioner 135.

FIG. 7 is a schematic diagram showing how the tachometer generator 116'' in circuit 106 is coupled to control the position of the groups of chests or other sources of heat in the double facer machine 60. Thus, the tachometer generator 116'' is coupled to the voltage sensitive relays 134, 136 and 138. Each voltage sensitive relay controls a valve for supplying air to a cylinder for raising or lowering groups of heat chests in the double facer machine 60. Also, each voltage sensitive relay 134–138 is coupled to its own manually set potentiometer to indicate the desired actuation point. In this manner, heat input to the web of paperboard is controlled in response to speed.

At startup time the operator will start up the drive of each of the circuits 102, 104 and 106 independently. Assume that the corrugator 10 is running. The operator control panels 112, 112' and 112'' are located along the length of the corrugator. When the operator wants to change speed, the operator pushes the FAST or SLOW button on any one of the control panels.

When the operator presses the FAST button at control panel 112, a voltage increase is reflected in conductor 120 at the voltage comparator 118. The comparator 118 senses the different voltages of the reference signal of conductor 120 and the feedback signal of conductor 122 and generates a control signal through conductor 126 to the single facer drive 110 which in turn increases the speed of the single facer motor 114. The single facer motor 114 increases in speed until the voltages from conductors 120 and 122 at comparator 118 are neutralized.

By opening switch 124 and closing switch 130 the single facer drive 110 and the single facer motor 114 will be responsive to and follow in synchronization with the double facer drive 110'' and the main drive motor 72. Comparator 118 now compares the reference signal of conductor 128 and the feedback signal of conductor 122 and generates a control signal to increase or decrease speed as a function of any difference between the signals. Thus, the reference signal from the double facer machine indicates desired speed to be attained and followed by the single facer machines.

Advantages include simplicity in operation. Also, the amount of unfinished corrugated board in process and in storage on the bridge 42 is controlled in a manner whereby the web components will have substantially the same moisture content or will be consistent in their relative amounts of moisture.

Immediately upstream from the slitter-scorer 64 there is preferably provided a device for tracking the edge of web and repositioning the knives as the web shifts. Such devices, per se, form no part of this invention. Likewise, many conventional features of a corrugator, wiring and circuitry, safety gates, etc. are not shown.

The present invention may be embodied in other specific forms without departing from the spirit or essential attributes thereof and, accordingly, reference should be made to the appended claims, rather than to the foregoing specification as indicating the scope of the invention.

It is claimed:

1. A method of making corrugated paperboard comprising making single faced paperboard in a single facer machine, feeding the single faced paperboard to a bridge, removing the single faced paperboard from the bridge and joining the single face board to a liner at a double facer machine, the improvement comprising producing a first signal indicative of the actual speed of the drive motor of the single facer machine, producing a second signal indicative of the actual speed of the drive motor of the double facer machine, producing a reference signal indicative of a desired speed, comparing the first signal with the reference signal and producing a first output signal, automatically adjusting the speed of the single facer drive motor in response to said first output signal, comparing the second signal with the reference signal and producing a second output signal, and automatically adjusting the speed of the double facer drive motor in response to said second output signal.

2. A method in accordance with claim 1 wherein said comparing steps include comparing the voltage of a signal representative of actual motor speed and the voltage of a signal representative of the desired speed so that each output signal is a voltage representative of the difference between the compared voltages.

3. A method in accordance with claim 1 including producing a signal indicative of any difference between actual and desired footage of the single faced paperboard on the bridge, and using said last mentioned signal to modify the reference signal before the reference signal is compared with the signal indicative of actual motor speed.

4. A method in accordance with claim 1 including selectively and alternatively using the desired speed of the drive unit of the single facer machine and the double facer machine as the reference signal so that the single facer machine may be operated independently or in synchronization with the double facer machine.

5. A corrugator for producing corrugated paperboard comprising first and second single facer machines each selectively and operatively associated with a double facer machine by way of a bridge extending therebetween, a discrete drive for each of said machines, each drive including a power unit and a motor, a discrete comparator coupled between each motor and its power unit, means including said comparators for causing the speed of each single facer machine to follow the speed of the double facer machine in synchronization therewith, said means including a motor operated potentiometer for said double facer machine which generates a reference signal corresponding to a desired speed, means for creating a tachometer feedback signal from each motor to its respective comparator to indicate actual motor speed, each comparator being electrically coupled to said motor operated potentiometer, and each comparator being electrically coupled to its respective drive to adjust the speed thereof as a function of any difference between said motor speed as indicated by said feedback signal and desired speed as indicated by said reference signal.

6. A corrugator in accordance with claim 5 wherein the double facer tachometer feedback signal is coupled to a plurality of voltage sensitive relays for controlling the position of heat sources at the double facer machine as a function of speed.

7. A corrugator in accordance with claim 5 including a control means for increasing and decreasing the reference signal to each single facer comparator as a function of the difference from a predetermined footage of single faced paperboard on the bridge.

8. A corrugator for producing corrugated paperboard comprising at least one single facer system coupled by a bridge with a double facer system, each of said systems including a discrete drive, each drive including a power unit and a motor for independent operation, feedback means including circuitry coupling each motor with its respective drive for correcting any deviation between actual and desired speeds of the motors, said circuitry including switch means for selectively coupling a speed reference signal of said double facer system to control the single facer system so that the single facer system may operate independently or in synchronization with the double facer system at variable speeds.

9. A corrugator in accordance with claim 8 wherein said circuitry and feedback means includes a comparator, means coupled to said comparator for generating a signal indicative of the speed of the single facer motor, and means coupled to said comparator for generating a reference signal indicative of desired speed for the single facer motor.

10. A corrugator in accordance with claim 8 wherein said circuitry and feedback means includes a voltage comparator between each motor and its power drive unit, and a control means for varying the double facer speed reference signal as a function of difference from a predetermined footage of single faced paperboard on said bridge.

11. An improved corrugator for producing corrugated paperboard at synchronous speeds having at least one single facer machine selectively and operatively associated with a double facer machine by way of a bridge extending therebetween, a discrete drive for each of said machines, each drive including a power unit and a motor wherein the improvement comprises a. a comparator coupled between each motor and its drive unit;

b. a motor operated potentiometer coupled to said double facer motor to generate a reference signal corresponding to a desired speed;

c. a tachometer-generator coupled to each motor for generating a feed-back signal from each motor to its comparator to indicate actual motor speed;

d. each comparator being electrically coupled to said motor operated potentiometer and each comparator being electrically coupled to its respective drive to adjust the speed thereof as a function of any difference between actual motor speed as indicated by said feed-back signal and the desired speed as indicated by said reference signal so that the speed of the single facer machine synchronously follows the speed of the double facer machine.

12. A corrugator for producing corrugated paperboard comprising at least one single facer machine operatively associated with a double facer machine by way of a bridge extending therebetween, a discrete drive for each of said machines, each drive including a power unit and a motor, the improvement comprising a discrete comparator connected between each motor and its associated power unit, and circuit means connected to and including said comparators for automatically causing the speed of the motor of the single facer machine to follow the speed of the drive unit of the double facer machine in synchronization therewith, and said circuit means including switch means for selectively disconnecting the comparator associated with the single facer motor to its power unit and to the drive unit of the double facer machine so that the single facer machine may be operated at a speed independent of the speed of the double facer machine.

* * * * *